US009303869B2

(12) United States Patent
Kasprzyk et al.

(10) Patent No.: US 9,303,869 B2
(45) Date of Patent: Apr. 5, 2016

(54) GAS PILOT BURNER ASSEMBLY

(75) Inventors: Donald J. Kasprzyk, Maple Grove, MN (US); Gregory Young, Richfield, MN (US); James Glenn Buezis, Plymouth, MN (US); Willem VanderWerf, Maple Grove, MN (US); Timothy J. Smith, Minneapolis, MN (US)

(73) Assignee: Honeywell International Inc., Morris Plains, NJ (US)

( * ) Notice: Subject to any disclaimer, the term of this patent is extended or adjusted under 35 U.S.C. 154(b) by 869 days.

(21) Appl. No.: 13/525,180

(22) Filed: Jun. 15, 2012

(65) Prior Publication Data

US 2013/0337389 A1 Dec. 19, 2013

(51) Int. Cl.

| | |
|---|---|
| ***F23Q 9/00*** | (2006.01) |
| ***F23D 14/46*** | (2006.01) |
| ***F23N 5/10*** | (2006.01) |
| ***F23D 14/06*** | (2006.01) |
| ***F23D 14/72*** | (2006.01) |

(52) U.S. Cl.

CPC ..... *F23D 14/46* (2013.01); *F23D 14/06* (2013.01); *F23D 14/725* (2013.01); *F23N 5/105* (2013.01); *F23D 2207/00* (2013.01); *F23D 2208/00* (2013.01); *F23N 2029/02* (2013.01); *F23N 2900/05005* (2013.01)

(58) Field of Classification Search

USPC ..... 431/258, 278, 343

See application file for complete search history.

(56) References Cited

U.S. PATENT DOCUMENTS

| | | | | |
|---|---|---|---|---|
| 2,609,870 | A | 9/1952 | Riebman et al. | |
| 2,665,749 | A | 1/1954 | Ebeltoft | |
| 2,746,530 | A * | 5/1956 | Young | F23D 5/00 431/285 |
| 2,859,263 | A | 11/1958 | Glickman | |
| 2,884,009 | A | 4/1959 | Hetherington | |
| 3,052,286 | A | 9/1962 | Kramer et al. | |
| 3,056,450 | A | 10/1962 | Loveland et al. | |
| 3,145,763 | A | 8/1964 | Loveland | |
| 3,147,343 | A | 9/1964 | Meyer et al. | |
| 3,173,472 | A | 3/1965 | Loveland | |
| 3,290,178 | A | 12/1966 | Loveland | |
| 3,291,186 | A | 12/1966 | Lindberg | |
| 3,313,564 | A | 4/1967 | Pultz | |
| 3,620,849 | A | 11/1971 | Thompson et al. | |
| 3,825,183 | A | 7/1974 | Machlanski | |
| 4,165,963 | A | 8/1979 | Nozaki | |
| 4,177,034 | A | 12/1979 | Jones | |
| 4,337,029 | A * | 6/1982 | McElroy et al. | 431/264 |
| 4,565,521 | A | 1/1986 | Hancock | |

(Continued)

FOREIGN PATENT DOCUMENTS

| | | |
|---|---|---|
| GB | 207311 | 11/1923 |
| GB | 956326 | 4/1964 |
| GB | 1224978 | 3/1971 |

OTHER PUBLICATIONS

Katherine M. Devries Smith, "Description of Honeywell Q5000 Water Heater Pilot Hardware," 10 pages, at least as early as Jul. 16, 2007.

*Primary Examiner* — Avinash Savani

(74) *Attorney, Agent, or Firm* — Seager, Tufte & Wickhem LLP

(57) ABSTRACT

A pilot burner assembly for easy removal of a thermo-electric or other device is disclosed. In an illustrative embodiment, a pilot burner assembly may include a bracket and a resilient clip, which together, help maintain at least some of the pilot burner components in a desired configuration.

20 Claims, 8 Drawing Sheets

(56) References Cited

U.S. PATENT DOCUMENTS

| | | | | |
|---|---|---|---|---|
| 5,039,300 | A | 8/1991 | Riehl | |
| 5,051,089 | A | 9/1991 | Jayaram | |
| 5,613,830 | A | 3/1997 | Chan et al. | |
| 6,056,540 | A | 5/2000 | Newman et al. | |
| 6,547,277 | B1 | 4/2003 | Adamini et al. | |
| 7,300,278 | B2 | 11/2007 | Vandrak et al. | |
| 2004/0069246 | A1* | 4/2004 | Donnelly et al. | 122/504 |
| 2010/0015560 | A1 | 1/2010 | Kasprzyk et al. | |
| 2011/0045423 | A1 | 2/2011 | Young et al. | |

* cited by examiner

GAS PILOT BURNER ASSEMBLY

TECHNICAL FIELD

The present disclosure relates generally to gas-fired burner assemblies.

BACKGROUND

Gas-fired appliances that cycle on and off often have a pilot burner that provides a flame whose purpose is to light the main burner of the appliance when there is a call for heat. In some cases, pilot burners can also provide a safety control mechanism to help ensure that if the pilot flame is extinguished for any reason, then the supply of gas to the whole appliance is cut off.

Pilot burners for gas-fired appliances often include a pilot burner tube which defines a flame opening at one end, a thermo-electric device and a spark source. The relative alignment and/or positioning of the various components of a pilot burner can affect the operation and/or reliability of the pilot burner. In some cases, several machined parts, fixtures, and/or assembly tools are required to help ensure that the pilot burner's functional tolerances are maintained, which can be difficult. Also, it can be desirable to allow a technician or other person to remove and/or replace one or more of the components of a pilot burner in the field. In many cases, this can be difficult and time consuming given the construction of many conventional pilot burners.

SUMMARY

The present disclosure relates generally to gas-fired burner assemblies, and more particularly, to pilot burner assemblies for gas-fired appliances. In one illustrative embodiment, a pilot burner assembly may include a bracket and a resilient clip, which together, help maintain at least some of the pilot burner components in a desired configuration. In one example, the bracket may include a first plate, a spaced second plate, and a third plate connecting the first plate and the second plate. In some instances, the first plate, the second plate and the third plate may collectively form a generally U-shape bracket, and may be a single piece if desired, but this is not required. The first plate and the second plate may each include an aperture, and when the pilot burner is assembled, a thermo-electric device may extend through the apertures in the first plate and the second plate. In some cases, the bracket may be configured to allow a gas feed line to pass between the thermo-electric device and the third plate. A resilient clip may be used to help hold the thermo-electric device within the apertures. In some cases, the clip may also be used to help hold the bracket relative to the gas feed line. In one example, the resilient clip may be positioned between the thermo-electric device and the gas feed line. The resilient clip may apply a bias force to the thermo-electric device in a first direction, which may bias the thermo-electric device against side walls of the apertures in the first and second plates to help hold the thermo-electric device in relation to the bracket. The clip may also apply a bias force to the gas feed line in a second direction, which in some cases, may bias the gas feed line against the bracket to help hold the bracket in relation to the gas feed line. More generally, it is contemplated that a bracket and resilient clip assembly may be used to more easily assemble, remove and/or replace one or more components of a pilot burner assembly.

BRIEF DESCRIPTION OF THE DRAWINGS

The disclosure may be more completely understood in consideration of the following description of various examples in connection with the accompanying drawings, in which.

Figure 1:
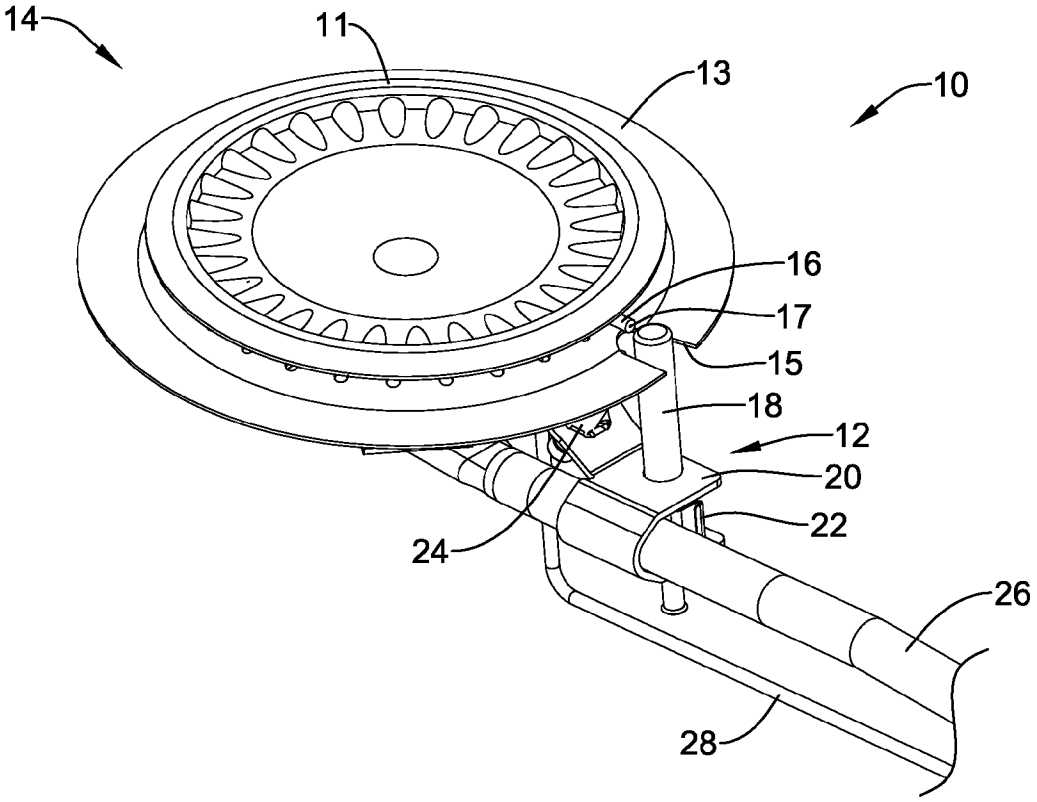
FIG. 1 is a perspective view of an illustrative burner assembly.

While the disclosure is amenable to various modifications and alternative forms, specifics thereof have been shown by way of example in the drawings and will be described in detail. It should be understood, however, that the intention is not to limit aspects of the disclosure to the particular examples described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several examples which are meant to be illustrative in nature.

FIG. 1 is a perspective view of an illustrative burner assembly 10 including a pilot burner assembly 12 and a main burner assembly 14. The main burner assembly 14 may include at least an upper plate 11 and a lower plate 13. The main burner assembly 14 may be connected to a gas supply via a main gas feed line 26. In FIG. 1, the illustrative pilot burner assembly 12 includes a burner tube 16, a thermo-electric device 18, and a spark source 24. The burner tube 16 defines a flame opening 17 at a first end, and a connection 28 to a gas supply (e.g. to an output of a gas valve) at a second end. In the illustrative embodiment shown, the first end of the burner tube may be configured to direct the flame towards thermo-electric device 18.

The thermo-electric device 18 may, for example, be a thermopile. It is contemplated that the thermo-electric device 18 may be any suitable thermoelectric device including a thermocouple or thermopile, as desired. A thermopile is a device that converts thermal energy into electrical energy. Typically, it is composed of thermocouples connected either in series or in parallel. For the pilot burner 12, it is possible for a single thermocouple to be used instead of a thermopile, but it is more common for a collection of thermocouples such as a thermopile to be used with a pilot burner. When a flame is present at the flame opening 17 of the burner tube 16, the flame or heat from the flame is directed to the body of the thermo-electric device 18. The thermo-electric device 18 then generates a voltage. The voltage may be directed to a gas valve that supplies gas to the burner assembly 10. A lack of voltage from the thermo-electric device 18, which would indicate a lack of a pilot flame in pilot burner assembly 12, may be used to close the gas valve. In this way, the pilot burner 12 may provide a safety mechanism for the flow of gas to a gas fired appliance. In some cases, the thermoelectric device may be a photoelectric device, which may generate a current based on light emitted from the pilot flame, rather than heat.

In the illustrative embodiment, the burner tube 16 is positioned generally perpendicular to the thermo-electric device 18, although this is not required. In some instances, the main burner assembly 14 may include structure to help maintain the orientation of the burner tube 16. A bracket 20 and resilient clip 22 may also be used to maintain the position of the thermo-electric device 18 relative to the burner tube 16. For example, in some instances, a bracket 20 may be used to maintain the thermo-electric device 18 within a notch or recess 15 in the lower plate 13 of the main burner assembly 14 adjacent to the flame opening 17 of the burner tube 16. In some cases, the bracket 20 may be formed from stamped metal, if desired. When so provided, certain features such as apertures, may be formed when the bracket is "blanked". If certain features "float" during the stamping operation, such as apertures, they will tend to float together and their positions may remain relatively fixed with respect to each other. This may help maintain the functional tolerances of the pilot burner components. In the illustrative embodiment, the bracket 20 may be generally "U" shaped, and may include retention features on one or both legs of the U-channel for maintaining the thermo-electric device 18 in a desired orientation. This may allow tighter tolerances on the functional dimensions to be maintained, without requiring adjustment or complicated fixtures in the factory or in the field.

Figure 2:
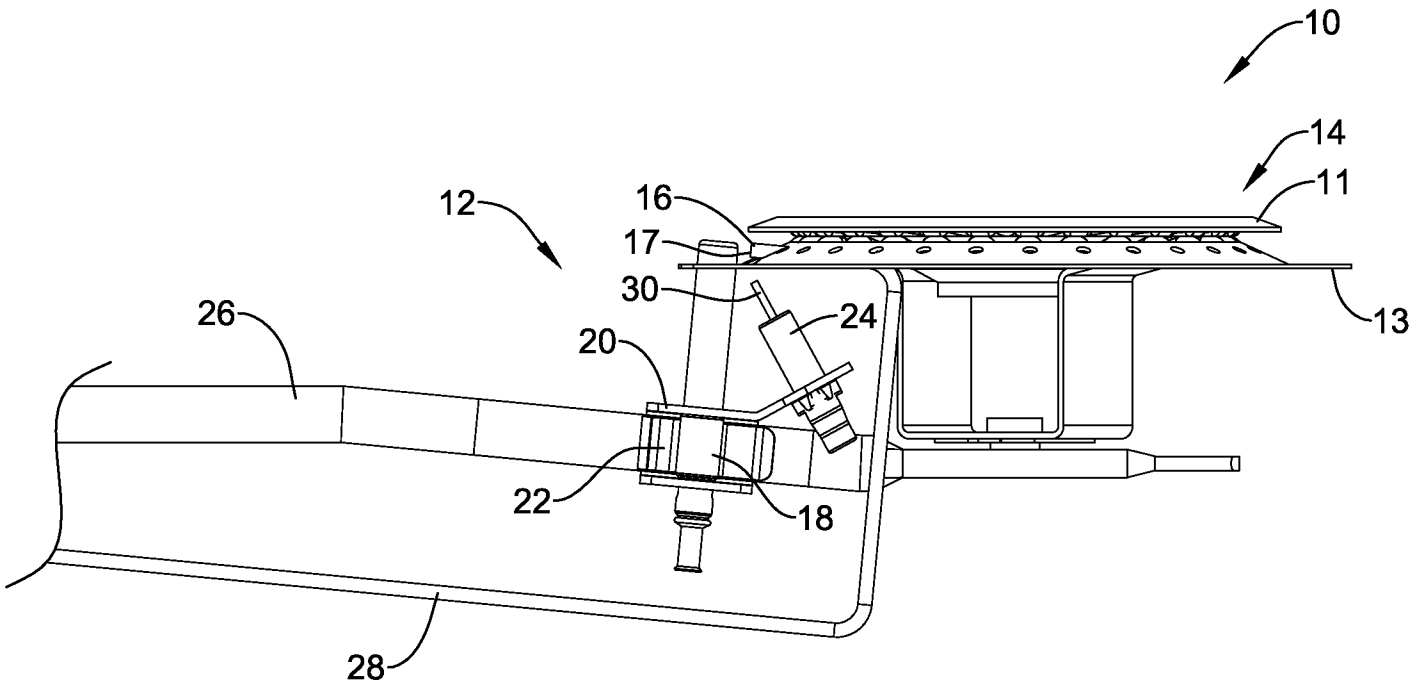
FIG. 2 is a side view of the illustrative burner assembly of FIG. 1.

FIG. 2 is a side view of an illustrative burner assembly 10 of FIG. 1. In some instances, while not explicitly shown, the burner tube 16 may engage or otherwise interact with the main burner assembly 14 to help maintain the orientation of the burner tube 16. For example, as will be discussed in more detail below, the burner tube 16 may extend through a hole or opening in the main burner assembly 14. It is contemplated that the main burner assembly 14 may include further structure to maintain the orientation/position of the burner tube 16. A spark source 24 may be positioned to orient the spark source 24 towards the flame opening 17 of the burner tube 16. Spark source 24 may include a spark rod 30 extending towards the flame opening 17 of the burner tube 16.

In some instances, the flame opening 17 of the burner tube 16 may be positioned under a portion of the main burner assembly 14 such that condensing water does not snuff out the pilot flame. This position may help prevent pilot flame instability and loss of pilot flame without the addition of a pilot hood or other further structure. It is further contemplated that the main burner may not direct main burner flame directly at the thermo-electric device, which may help prevent excess heat when the main burner assembly 14 is on. This may help prevent output drops in the thermo-electric device 18 when the main burner turns off.

Figure 3:
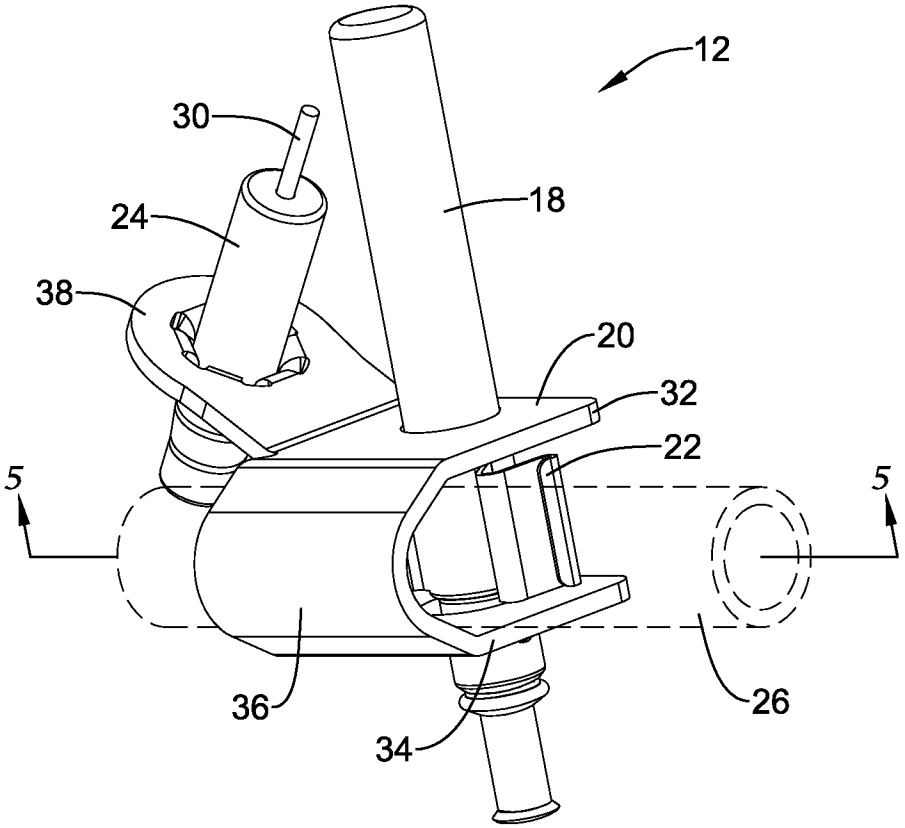
FIG. 3 is a perspective view of a pilot burner assembly of the illustrative burner assembly of FIG. 1.
Figure 4:
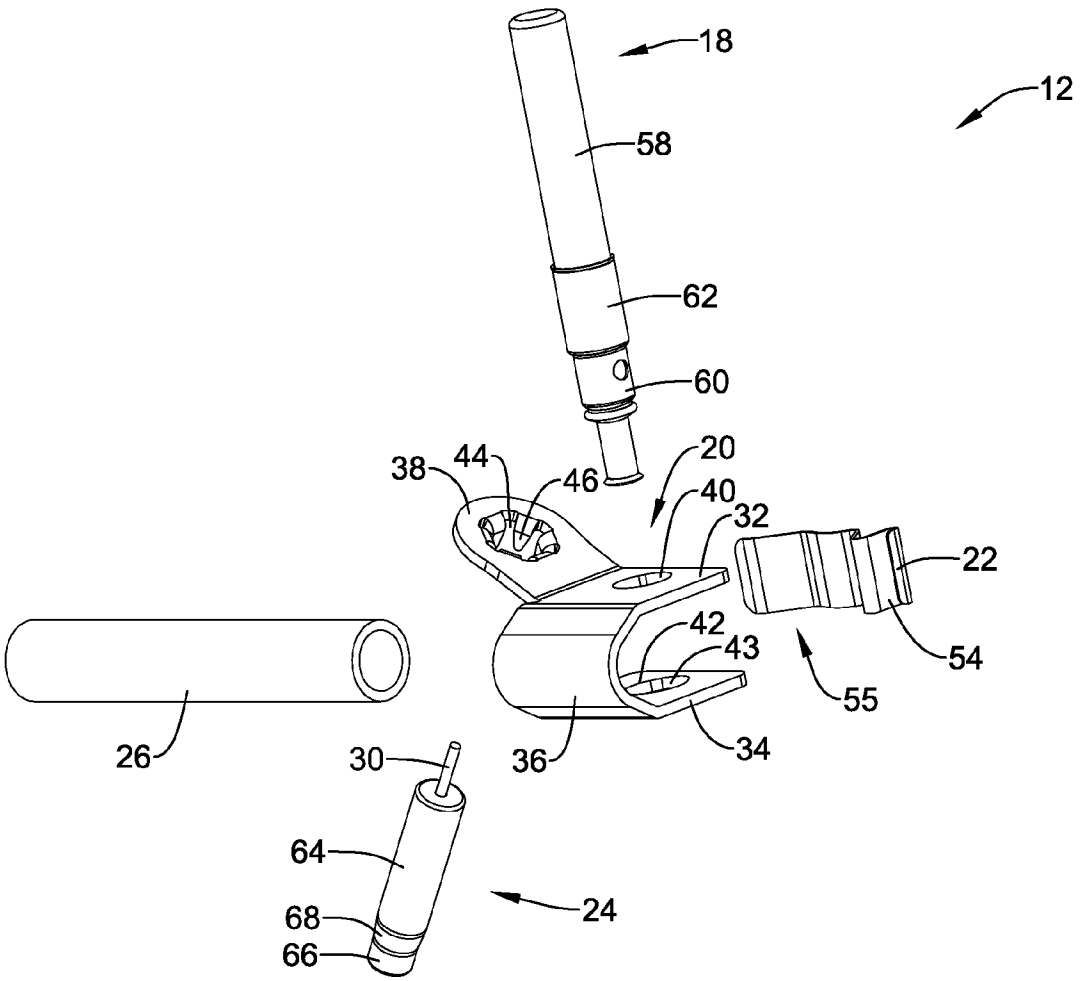
FIG. 4 is an exploded view of the illustrative pilot burner assembly of FIG. 3.

The various components of the illustrative pilot burner assembly 12 will now be described in more detail with reference to FIGS. 3 and 4. FIG. 3 is a perspective view of the illustrative pilot burner assembly 12 of FIG. 1, and FIG. 4 is an exploded view of the illustrative pilot burner assembly 12 of FIG. 3. In FIGS. 3 and 4, for clarity, only a portion of the main gas feed line 26 is illustrated. It is to be understood that as discussed above, the main gas feed line 26 is generally configured to extend from the main burner assembly 14 and a gas source (not explicitly shown). Additionally, in order to more clearly show the relationship of the resilient clip 22 relative to the thermo-electric device 18, the bracket 20 and the main gas feed line 26, the main gas feed line 26 has been shown in phantom in FIG. 3.

In the example shown, and as best seen in FIG. 4, the bracket 20 may have a general "U channel" shape that is defined by a first plate 32 and a spaced second plate 34, with a third plate 36 extending between the first plate 32 and the second plate 34. In some instances, the third plate 36 may have a generally curved profile configured to generally correspond to the shape of the main gas feed line 26, but this is not required. It is contemplated that in some instances, the third plate 36 may be positioned perpendicular to the first and second plates 32, 34. In some embodiments, the bracket 20 and/or the main gas feed line 26 may include features configured to align the bracket 20 and/or the main gas feed line 26 in a desired orientation and/or location, as will be discussed in more detail below. In some instances, the first plate 32, second plate 34, and third plate 36 may be formed as a single piece, but this is not required.

Figure 6:
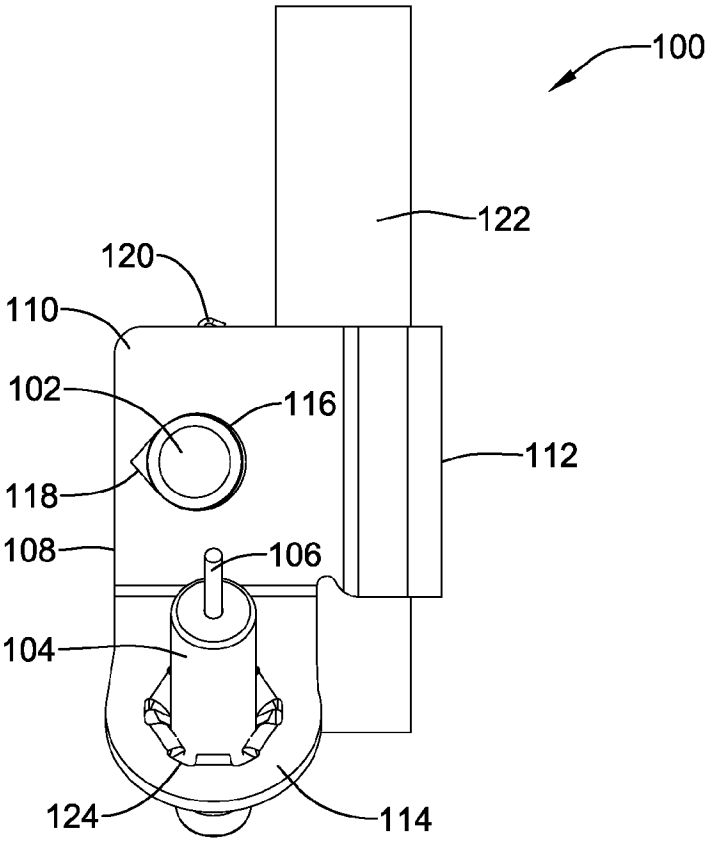
FIG. 6 is top view of an alternative pilot burner assembly.

The first plate 32 may include a first aperture 40. The second plate 34 may include a first aperture 42. The first aperture 40 of the first plate 32 may be generally aligned with the first aperture 42 of the second plate 34 (e.g. aligned along a common axis). In the example shown, the first apertures 40, 42 may be configured to receive the thermo-electric device 18 therethrough. While first apertures 40, 42 are shown as having a generally circular cross-section, it is contemplated that the cross-section may be of any shape desired. For example, in some instances, the apertures 40, 42 may include "V-block" features for component alignment, as shown in FIG. 6.

Aperture 42 in the second plate 34 may include a retention feature 43 for cooperating with a retention feature 62 of the thermo-electric device 18. The retention feature 44 may include a region of reduced profile relative to the aperture 42 to provide a hard stop and to engage the retention feature 62 of the thermo-electric device 18. This may help maintain the thermo-electric device 18 in a desired position relative to the other burner assembly components, as will be discussed in more detail below. A resilient clip 22 may include a handle portion 54 and a second portion 55 extending from the handle portion 54. In some instances, the second portion 55 of the clip 22 may be positioned between the thermo-electric device 18 and main gas feed line 26. The structure of the resilient clip 22 will be discussed in more detail below with respect to FIG. 5. In some embodiments, the resilient clip 22 may be positioned between the main gas feed line 26 and the thermo-electric device 18 such that the clip 22 exerts a biasing force on the thermo-electric device 18, biasing the thermo-electric device 18 against side walls of the first apertures 40,42, and in some cases, towards the retention feature 44 and away from, or opposite from the gas feed line 26. It is further contemplated that the resilient clip 22 may exert a biasing force on the main gas feed line 26, biasing the gas feed line 26 towards the third plate 36 of the bracket 20, and away from, or opposite from the thermo-electric device 18.

Referring to FIGS. 3 and 4, the bracket 20 may include an angled plate 38 extending from the first plate 32, as shown. The angled plate may include an aperture 44 configured to receive spark source 24. The angled plate 38 may be positioned to orient the spark source 24 towards the flame opening 17 of the burner tube 16. Spark source 24 may include a spark rod 30 extending towards the flame opening 17 of the burner tube 16. The aperture 44 may include "finger" like protrusions 46 that are configured to engage the spark source 24 and maintain the spark source 24 in a desired position relative to the burner tube 16. It is contemplated that the angled plate 38 may extend from the first plate 32 at any location desired that allows the spark source 24 to be positioned towards the flame opening 17 of the pilot burner tube 16.

Referring specifically to FIG. 4, the thermo-electric device 18 may include a first region 58 having a first cross-sectional area. In some embodiments, the cross-sectional area of the first region 58 may be approximately equal to the cross-sectional area of apertures 40, 42. In other embodiments the cross-sectional area of the first region 58 may be smaller than the cross-sectional area of the apertures 40, 42. In some cases, the thermo-electric device 18 may include a second region 60 having a second cross-sectional area. The second cross-sectional area may be smaller than, the same as, or larger than the first cross-sectional area of the first region 58, as desired. Disposed between the first region 58 and the second region 60 may be a third region, or sometimes referred to as a retention feature 62, that has a cross-sectional area that is larger than the first cross-sectional area.

In the illustrative embodiment, the spark source 24 may include a generally tubular structure having a first end 64 and a second end 66, with a tapered region 68 disposed therebetween. The first region 64 may have a cross-sectional area that is larger than the second region 66. As will be discussed in more detail below, the first region 64 may be received by aperture 44 on the angled portion 38 of the bracket 20. One example of a spark source that can be used with the pilot burner is a piezoelectric sparker or other type of spark source, as desired.

To assemble the pilot assembly 12, the bracket 20 may be slid over the main gas feed line 26 towards the main burner assembly 14. Once, the bracket 20 is positioned on the main gas feed line 26, the thermo-electric device 18 may be slid into the apertures 40, 42 in the first and second plates 32, 34 of the bracket. The thermo-electric device 18 may be slid upwards though the apertures 40, 42 until a bottom portion of the retaining feature 62 slides through and is disposed above aperture 42. The aperture 42 may be sufficiently large to allow the retaining feature 62 to pass through.

The aperture 42 may include a reduced dimension retaining feature 43, defined by the side wall of the aperture 42 that is away from the third plate 36. After the retaining feature 62 of the thermo-electric device 18 is slid through the aperture 42, the thermo-electric device 18 may be pushed or biased away from the third plate 36 and toward the reduced dimension retaining feature 43. The reduced dimension retaining feature 43 may be sized to accommodate the second region 60 of the thermo-electric device 18 but not the retaining feature 62, thereby creating a positive stop and preventing the thermo-electric device 18 from disassociating from the bracket 20.

As will be discussed in more detail with respect to FIG. 5, in some cases the resilient clip 22 may be inserted between the thermo-electric device 18 and the gas feed line 26 to secure the thermo-electric device 18 within the bracket 20. The clip 22 may provide a biasing force to fully engage the retaining feature 62 of the thermo-electric device 18 with the retaining feature 43 of the aperture 42. The thermo-electric device 18 may be removed from the bracket 20 by simply removing the clip, disengaging the retaining features 62, 43 by moving the thermo-electric device 18 towards the third plate 36, and pulling the thermo-electric device 18 from the apertures 40, 42. This may allow the thermo-electric device 18 to be removed from the bracket 20 (without using tools) for easy field maintenance and/or replacement.

Once assembled, the bracket 20 and thermo-electric device 18 may be slid along the main gas feed line 26 until the thermo-electric device 18 is aligned with the pilot burner tube 16. For example, the thermo-electric device 18 may be positioned within slot 15 in the main burner assembly 14, if so provided, although this is not required. It is further contemplated that the bracket 20 may be positioned adjacent to the pilot burner tube 16 prior to inserting the thermo-electric device 18 and the clip 22. In some embodiments, once the pilot assembly 12 is aligned with the pilot burner tube 16 and the main burner assembly 14, the main gas feed line 26 may be deformed to prevent the pilot assembly 12 from moving, but this is not required. For example, the main gas feed line 26 may be bent slightly to prevent further movement of the pilot assembly 12 along the length of the gas feed line 26.

The spark source 24 may be positioned within the angled portion 38 of the bracket 20 by sliding the second region 66 of the spark source 24 through aperture 44 until the first region 64 comes into frictional engagement with protrusions 46. The new frictional engagement of the first region 64 with the protrusions 46 may maintain the spark source 24 in a desired position relative to the thermo-electric device 18 and pilot burner tube 16.

Figure 5:
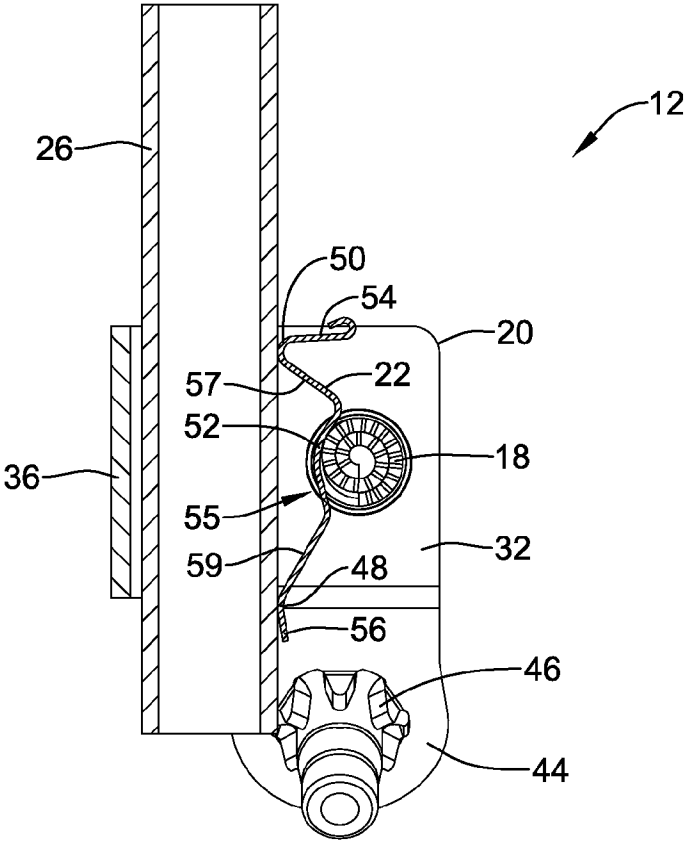
FIG. 5 is a cross-sectional view of the illustrative pilot burner assembly of FIG. 3 taken along line 5-5.

FIG. 5 is a cross-sectional view of the illustrative pilot assembly 12 taken at line 5-5 shown in FIG. 3. As can be seen, when assembled, the resilient clip 22 may be positioned between the thermo-electric device 18 and the main gas feed line 26. In some embodiments, the resilient clip 22 may be formed from stainless steel, although this is not required. It is contemplated that the clip 22 may be formed of any suitable material as desired. In the illustrative embodiment, the resilient clip 22 includes a first gripping portion 54 at a first end, and a second elongated portion 55 extending therefrom to a second end 56. The second end 56 of the resilient clip 22 may include a "lead-in" feature, such as an angled end, that may help guide the resilient clip between the gas feed line 26 and the thermo-electric device 18 during assembly. The gripping portion 54 may be sized and shaped to allow a user to grip the clip 22, such as with fingers, and exert a force on the clip 22 to insert and/or remove it from the pilot assembly 12. During assembly, a user my grip the gripping portion 54 and guide the second end 56 between the thermo-electric device 18 and the gas feed line 26. The user may continue to advance the clip 22 until the clip 22 engages both the thermo-electric device 18 and the gas feed line 26 as shown.

The second portion 55 of the clip 22 may include a number of curved and/or angled regions configured to engage either the thermo-electric device 18 or the gas feed line 26. In the example shown, the resilient clip 22 is configured to contact the main gas feed line 26 at a first curved region 50 adjacent to the gripping portion 54 and a second slightly curved region 48 adjacent to the second end 56 of the clip 22. The clip 22 may further include an intermediate region 52 disposed between the regions 48, 50. The intermediate region 52 may be slightly curved and may be configured to contact the thermo-electric device 18. In some instances, the intermediate region 52 may be configured to generally conform to the surface of the thermo-electric device 18. In some instances, the clip 22 may further include angled regions 57, 59 between the regions 48, 50 configured to contact the gas feed line 26 and the intermediate region 52. These regions 57, 59 may be sized such that when the clip 22 is inserted between the thermo-electric device 18 and the main gas feed line 26, a biasing force is exerted on the thermo-electric device 18 and the main gas feed line 26. In the example shown, it is contemplated that the clip 22 may be used to assemble and/or disassemble the pilot assembly 12 without tools, mounting hardware, welding, or other attachment elements.

The resilient clip 22 may have a first generally unstressed position when the clip 22 is not positioned within the bracket 20 or between the thermo-electric device 18 and the main gas feed line 26. The resilient clip 22 may have a second position when positioned within the bracket 20 and between thermo-electric device 18 and the main gas feed line 26. In the second position, the resilient clip 22 may be under stress and may provide a bias force to the thermo-electric device 18 such that the thermo-electric device 18 is biased away from the gas feed line 26 and towards the retention feature in the bracket 20. In the second position, the resilient clip 22 may also provide a bias force to the main gas feed line 26 such that the gas feed line 26 is biased away from the thermo-electric device 18 and towards the third plate 36 of the bracket 20.

FIG. 6 illustrates a top view of an alternative illustrative pilot burner assembly 100. The pilot assembly 100 may be configured to be used in conjunction with a main burner assembly, such as main burner assembly 14 shown in FIG. 1. The illustrative pilot burner assembly 100 includes a thermo-electric device 102 and a spark source 104. While not explicitly shown, the pilot burner assembly 100 may be configured to be used with a pilot burner tube, such as burner tube 16 illustrated in FIG. 1. Similar to FIGS. 3 and 4, for clarity, only a portion of the main gas feed line 122 configured to be connected to a gas source and a main burner is illustrated. It is to be understood that as discussed above, the main gas feed line 122 is generally configured to extend from the main burner assembly, such as main burner assembly 14 shown in FIG. 1, and a gas source (not explicitly shown).

In the example shown, the bracket 108 may have a general "U channel" shape that is defined by a first plate 110, a spaced second plate (not explicitly shown), and a third plate 112 extending between the first plate 110 and the second plate. In some instances, the third plate 112 may have a generally curved profile configured to generally correspond to the shape of the main gas feed line 122, but this is not required. In some embodiments, the bracket 108 and/or the main gas feed line 122 may include features configured to align the bracket 108 and/or the main gas feed line 122 in a desired orientation and/or location, as will be discussed in more detail below.

The bracket 108 may be similar in form and function to bracket 20 discussed above. The first plate 110 may include a first aperture 116. The second plate may also include a first aperture generally aligned with the first aperture 116 of the first plate 110. The apertures 116 may be configured to receive the thermo-electric device 102 therethrough. In some instances, the first aperture 116 may include a "v-block" feature 118 for component alignment. For example, the "v" shape may help align the thermo-electric device 102 in a particular orientation and/or position. While not explicitly shown, the aperture in the second plate may also include a "v-block" feature which may further help align the thermo-electric device 102. It is further contemplated that a "v" shape may also act as a retention feature in cooperation with retention features on the thermo-electric device 102 in a manner similar to the retention features described with respect to FIGS. 3 and 4. However, it is contemplated that the apertures 116 may have any shape as desired.

The bracket 108 may further include an angled plate 114 extending from the first plate 110, as shown. The angled plate may include an aperture 124 configured to receive spark source 104. The angled plate 114 may be positioned to orient the spark source 104 towards a flame opening, such as flame opening 17 shown in FIG. 1, of a pilot burner tube, such as pilot burner tube 16, shown in FIG. 1. Spark source 104 may include a spark rod 106 extending towards the flame opening of the burner tube. The aperture 124 may include "finger" like protrusions that are configured to engage the spark source 104 and maintain the spark source 104 in a desired position relative to the pilot burner tube. It is contemplated that the angled plate 114 may extend from the first plate 110 at any location desired that allows the spark source 104 to be positioned towards the flame opening of the pilot burner tube.

The pilot assembly 100 may also include a resilient clip 120 positioned between the thermo-electric device 102 and main gas feed line 122. The resilient clip 120 may be similar in form and function to the clip 22 described with respect to FIGS. 1-5. In some embodiments, the resilient clip 120 may be positioned between the main gas feed line 122 and the thermo-electric device 102 such that the clip 120 exerts a biasing force on the thermo-electric device 102, biasing the thermo-electric device 102 towards the v-block feature 118. It is further contemplated that the resilient clip 120 may exert a biasing force on the main gas feed line 122, biasing the feed line 122 towards the third plate 112 of the bracket 108.

Figure 7:
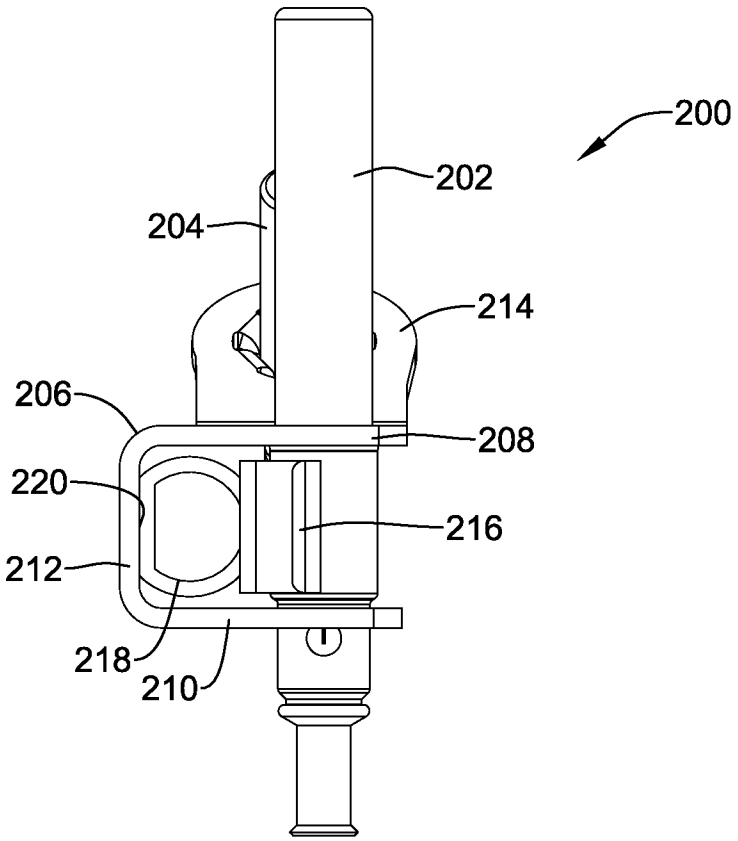
FIG. 7 is a side view of another alternative pilot burner assembly.

FIG. 7 illustrates a side view of an alternative illustrative pilot burner assembly 200. The pilot assembly 200 may be configured to be used in conjunction with a main burner assembly, such as main burner assembly 14 shown in FIG. 1. The illustrative pilot burner assembly 200 includes a thermo-electric device 202 and a spark source 204. While not explicitly shown, the pilot burner assembly 200 may be configured to be used with a pilot burner tube, such as burner tube 16 illustrated in FIG. 1. Similar to FIGS. 3 and 4, for clarity, only a portion of the main gas feed line 218 configured to be connected to a gas source and a main burner is illustrated. It is to be understood that as discussed above, the main gas feed line 218 is generally configured to extend from the main burner assembly and a gas source (not explicitly shown).

In the illustrative embodiment, the bracket 206 may have a general "U channel" shape that is defined by a first plate 208, a spaced second plate 210, and a third plate 212 extending between the first plate 208 and the second plate 210. In some instances, the third plate 212 may be generally perpendicular to the first and second plates 208, 210, but this is not required. In some embodiments, the bracket 206 and/or the main gas feed line 218 may include features configured to align the bracket 206 and/or the main gas feed line 218 in a desired orientation and/or location. For example, in some instances, the main gas feed line 218 may include a region that has been deformed to include a generally flat region 220 configured to mate with the inner wall of the third plate 212. This flat region 220 may be located at a position adjacent to the main burner assembly such that when the bracket 206 is aligned with the flat region 220, the pilot assembly 200 is properly aligned with the main burner and the pilot burner tube.

The bracket 206 may be similar in form and function to bracket 20 discussed above. The first and second plates 208, 210 may each include an aperture (not explicitly shown). The apertures in the first and second plates 208, 210 may be generally aligned with one another. The apertures may be configured to receive the thermo-electric device 202 therethrough. One or more of the apertures may include features, such as a "v-block" feature, for component alignment, although this is not required. In some instances, one or more of the apertures may include a retention feature configured to cooperate with retention features on the thermo-electric device 202 in a manner similar to the retention features described with respect to FIGS. 3 and 4.

The bracket 206 may further include an angled plate 214 extending from the first plate 208, as shown. The angled plate may include an aperture (not explicitly shown) configured to receive spark source 204. The angled plate 214 may be positioned to orient the spark source 204 towards the flame opening of the pilot burner tube. Spark source 204 may include a spark rod, such as spark rod 24 shown in FIG. 1, extending towards the flame opening of the burner tube. The aperture may include "finger" like protrusions that are configured to engage the spark source 204 and maintain the spark source 204 in a desired position relative to the pilot burner tube. It is contemplated that the angled plate 214 may extend from the first plate 208 at any location desired that allows the spark source 204 to be positioned towards the flame opening of the pilot burner tube.

The pilot assembly 200 may also include a resilient clip 216 positioned between the thermo-electric device 202 and main gas feed line 218. The resilient clip 216 may be similar in form and function to the clip 22 described with respect to FIGS. 1-5. In some embodiments, the resilient clip 216 may be positioned between the main gas feed line 218 and the thermo-electric device 202 such that the clip 216 exerts a biasing force on the thermo-electric device 202, biasing the thermo-electric device 202 away from the gas feed line 218. It is further contemplated that the resilient clip 216 may exert a biasing force on the main gas feed line 218, biasing the feed line 218 towards the third plate 212 of the bracket 206.

Figure 8:
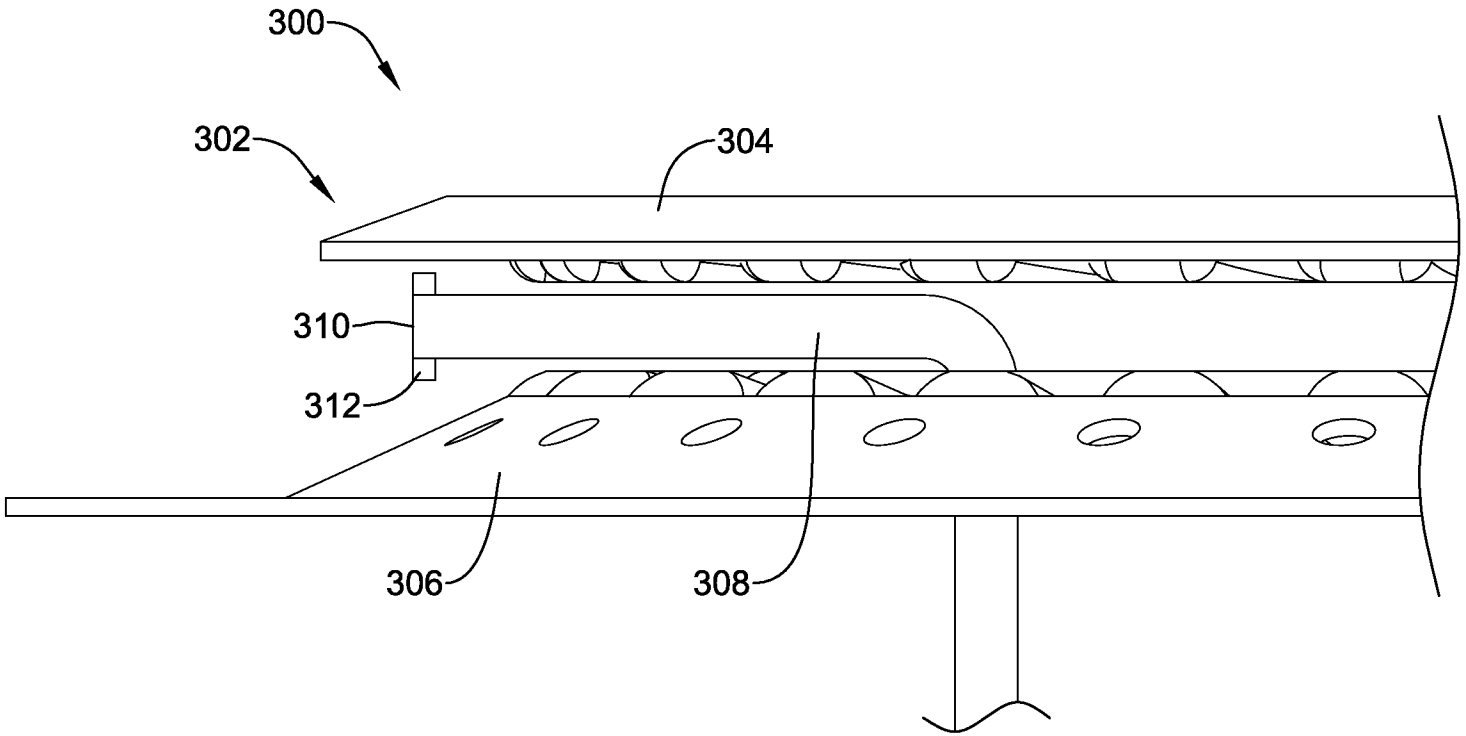
FIG. 8 is a partial side view of an alternative burner assembly.

FIG. 8 illustrates a partial side view of an alternative burner assembly 300. The main burner assembly 302 may include an upper plate 304 and a lower plate 306. The burner assembly 300 may further include a pilot burner tube 308 having a flame opening 310 as well as a pilot assembly, such as but not limited to, pilot assembly 12 shown in FIG. 1, but not explicitly shown in FIG. 8. In some instances, the upper and lower plates 304, 306 may include features configured to maintain the pilot burner tube 308 in a desired orientation/location. For example, it may be desirable to position the flame opening 310 under the upper plate 304 such that condensing water does not snuff out the pilot flame. This position may help prevent pilot flame instability and loss of pilot flame without the addition of a pilot hood or other further structure. It is further contemplated that the main burner may not direct main burner flame directly at the thermo-electric device, which may help prevent excess heat when the main burner assembly 302 is on. This may help prevent output drops in the thermo-electric device when the main burner 302 turns off.

In some instances, the pilot burner tube 308 may be positioned between the upper and lower plates 304, 306. While not explicitly shown, the upper and lower plates 304, 306 may be structured to form a channel around the pilot burner tube 308 to prevent lateral movement in the burner tube 308. In some embodiments, the pilot burner tube 308 may further include a flange 312 positioned adjacent to the flame opening 310. The flange 312 may limit how far the pilot burner tube 308 can retract under the upper plate 304. This may further help maintain the orientation and/or location of the pilot flame relative to the thermo-electric device, such as thermo-electric device 18 shown in FIG. 1.

Those skilled in the art will recognize that the present disclosure may be manifested in a variety of forms other than the specific examples described herein. Accordingly, departure in form and detail may be made without departing from the scope and spirit of the present disclosure as described in the appended claims.

What is claimed is:

1. A pilot burner assembly, comprising:

a bracket, the bracket having:

a first plate;

a second plate spaced from the first plate; and a third plate interconnecting the first plate and the second plate, the first plate, the second plate and the third plate collectively defining a channel;

the first plate and the second plate each defining a first aperture, wherein the first aperture of the first plate receives a first part of a thermo-electric device body and the first aperture of the second plate receives a second part of the thermo-electric device body;

a gas feed line extending through the channel defined by the first plate, the second plate and the third plate and transverse to the thermo-electric device body when the thermo-electric device body is inserted into the first apertures of the first plate and second plate; and a resilient clip positioned relative to the thermo-electric device body and the gas feed line, the resilient clip configured to hold the thermo-electric device body in place relative to the bracket when the thermo-electric device body is inserted into the first apertures of the first plate and second plate.

2. The pilot burner assembly of claim 1, wherein the clip is positioned between the first plate and the second plate.

3. The pilot burner assembly of claim 1, wherein clip is positioned between the thermo-electric device body and the gas feed line.

4. The pilot burner assembly of claim 1, wherein the clip holds the bracket in place relative to the gas feed line when the gas feed line extends through the channel defined by the first plate, the second plate and the third plate.

5. The pilot burner assembly of claim 1, wherein the clip comprises a first end having a gripping portion and a second elongated portion extending from the gripping portion to a second end.

6. The pilot burner assembly of claim 5, wherein the second end comprises a lead in region to help guide the clip between the thermo-electric device body and the gas feed line.

7. The pilot burner assembly of claim 5 further comprising an intermediate region disposed between the gripping portion and the second end, the intermediate region configured to contact the thermo-electric device body.

8. The pilot burner assembly of claim 7 further comprising a first curved region adjacent to the gripping portion and a second curved region adjacent to the second end, the first and second curved regions configured to contact the gas feed line.

9. The pilot burner assembly of claim 1, wherein the clip applies a bias force to the thermo-electric device body in a first direction and the clip applies a bias force to the gas feed line in a second different direction.

10. The pilot burner assembly of claim 9, wherein the clip holds the bracket and the thermo-electric device body in fixed orientation relative to one another.

11. The pilot burner assembly of claim 3, wherein the clip biases the thermo-electric device body against a retention feature of the first aperture of the second plate.

12. The pilot burner assembly of claim 3 wherein the thermo-electric device body includes a feature that cooperates with a retention feature in the first aperture of the second plate.

13. The pilot burner assembly of claim 1 wherein the first plate, the second plate and the third plate form a U-shaped bracket and are a single piece.

14. A pilot burner assembly, comprising:

a bracket, the bracket having:

a first plate;

a second plate spaced from the first plate; and a third plate interconnecting the first plate and the second plate;

the first plate and the second plate each defining a first aperture for receiving a first pilot burner component body therethrough;

a gas feed line positioned between the first plate and the second plate of the bracket and adjacent to the third plate so as to extend transverse to the first pilot burner component body when the first pilot burner component body is inserted into the apertures of the first plate and second plate;

a resilient clip, including at least a portion situated between the first plate and the second plate, for holding both the first pilot burner component body and the bracket in place relative to the gas feed line when the first pilot burner component body is inserted into the apertures of the first plate and second plate.

15. The pilot burner assembly of claim 14 wherein the clip is disposed between the first pilot burner component and the gas feed line.

16. The pilot burner assembly of claim 15 wherein the clip exerts a biasing force on the gas feed line such that the gas feed line is biased towards the third plate and the clip exerts a biasing force on the first pilot burner component such that the first pilot burner component is biased away from the gas feed line and against a side walls of the first apertures in the first plate and the second plate.

17. The pilot burner assembly of claim 14, wherein a first portion of the clip is configured to contact the first pilot burner component and a second portion of the clip is configure to contact the gas feed line.

18. A pilot burner assembly, comprising:

A bracket having a first leg, a second leg, and a third leg interconnecting the first leg to the second leg to form a channel; the first leg defining a first aperture;

the second leg defining a second aperture, wherein the first aperture and the second aperture are generally aligned along an axis;

the second aperture having a retention feature that is configured to cooperate with a retention feature in a first pilot burner component body;

a gas feed line extending through the channel defined by the bracket adjacent the third leg and transverse to the axis;

a resilient clip configured to bias the first pilot burner component body such that the retention feature in the first pilot burner component body engages the retention feature of the second aperture.

19. The pilot burner assembly of claim 18 wherein the clip is disposed between the gas feed line and the first pilot burner component body.

20. The pilot burner assembly of claim 19 wherein when clip holds the bracket and the first pilot burner component body in a fixed orientation relative to one another.

* * * * *